US009509039B2

(12) United States Patent
Kadosawa et al.

(10) Patent No.: US 9,509,039 B2
(45) Date of Patent: Nov. 29, 2016

(54) PORTABLE TERMINAL DEVICE AND WIRELESS COMMUNICATION METHOD

(71) Applicant: FUJITSU LIMITED, Kawasaki-shi, Kanagawa (JP)

(72) Inventors: Yoshihisa Kadosawa, Funabashi (JP); Masaru Kanazawa, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 219 days.

(21) Appl. No.: 13/933,577

(22) Filed: Jul. 2, 2013

(65) Prior Publication Data

US 2014/0015715 A1 Jan. 16, 2014

(30) Foreign Application Priority Data

Jul. 12, 2012 (JP) ..... 2012-156884

(51) Int. Cl.
*H01Q 1/24* (2006.01)
*H01Q 9/42* (2006.01)

(52) U.S. Cl.
CPC ..... *H01Q 1/243* (2013.01); *H01Q 9/42* (2013.01)

(58) Field of Classification Search
USPC ..... 343/702, 700 MS, 767
See application file for complete search history.

(56) References Cited

U.S. PATENT DOCUMENTS

| | | | | |
|---|---|---|---|---|
| 7,242,353 | B2 * | 7/2007 | Hung | H01Q 1/22 343/702 |
| 7,893,877 | B2 * | 2/2011 | Wang | H01Q 1/2258 343/700 MS |
| 8,125,772 | B2 * | 2/2012 | Kim | G02F 1/133308 343/702 |
| 2002/0021250 | A1 * | 2/2002 | Asano | H01Q 1/22 343/702 |

FOREIGN PATENT DOCUMENTS

| | | | |
|---|---|---|---|
| JP | 2003-8320 | A | 1/2003 |
| JP | 2006-172010 | A | 6/2006 |
| JP | 2009-60268 | A | 3/2009 |
| JP | 2009-267895 | A | 11/2009 |
| WO | 2010/035317 | A1 | 4/2010 |

OTHER PUBLICATIONS

Japanese Office Action dated Jan. 26, 2016, issued in Japanese Patent Application No. 2012-156884, with relevant translation (6 pages).

Decision of Refusal dated Jun. 28, 2016, issued in counterpart Japanese Patent Application No. 2012-156884, with English translation (6 pages).

* cited by examiner

*Primary Examiner* — Hoang V Nguyen
*Assistant Examiner* — Hai Tran
(74) *Attorney, Agent, or Firm* — Westerman, Hattori, Daniels & Adrian, LLP

(57) ABSTRACT

A portable terminal includes a metal frame on which an LCD is mounted, the metal frame being grounded; and an antenna element that includes a feed point between a first end and a second end and is formed from the same piece of sheet metal used for the metal frame, the first end of the antenna element being connected to the metal frame.

12 Claims, 8 Drawing Sheets

PORTABLE TERMINAL DEVICE AND WIRELESS COMMUNICATION METHOD

CROSS-REFERENCE TO RELATED APPLICATION

This application is based upon and claims the benefit of priority of the prior Japanese Patent Application No. 2012-156884, filed on Jul. 12, 2012, the entire contents of which are incorporated herein by reference.

FIELD

The embodiments discussed herein are related to a portable terminal device and wireless communication method.

BACKGROUND

In a typical portable terminal device, an antenna is provided in a display side housing and forms part of an exterior face in cooperation with the display side housing, and the exterior face is provided with an antenna conductor of the antenna. In the portable terminal device, the antenna conductor is arranged far away from a circuit board, a ground conductor, or the like. Such techniques are disclosed in, for example, Japanese Laid-open Patent Publication No. 2009-060268.

SUMMARY

According to an aspect of the invention, a portable terminal includes a metal frame on which an LCD is mounted, the metal frame being grounded; and an antenna element that includes a feed point between a first end and a second end and is formed from the same piece of sheet metal used for the metal frame, the first end of the antenna element being connected to the metal frame.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

A typical portable terminal device includes an antenna that forms part of an exterior face in cooperation with a display side housing so that an antenna conductor is arranged far away from a circuit board, a ground conductor, or the like.

Such a portable terminal device involves a large number of components for the antenna and has high manufacturing costs. The techniques disclosed in the below-described embodiments may provide a portable terminal device with low manufacturing costs.

A portable terminal device according to a comparative example is described first below before describing the embodiments to which a portable terminal device according to the present application is applied.

Figure 1B:
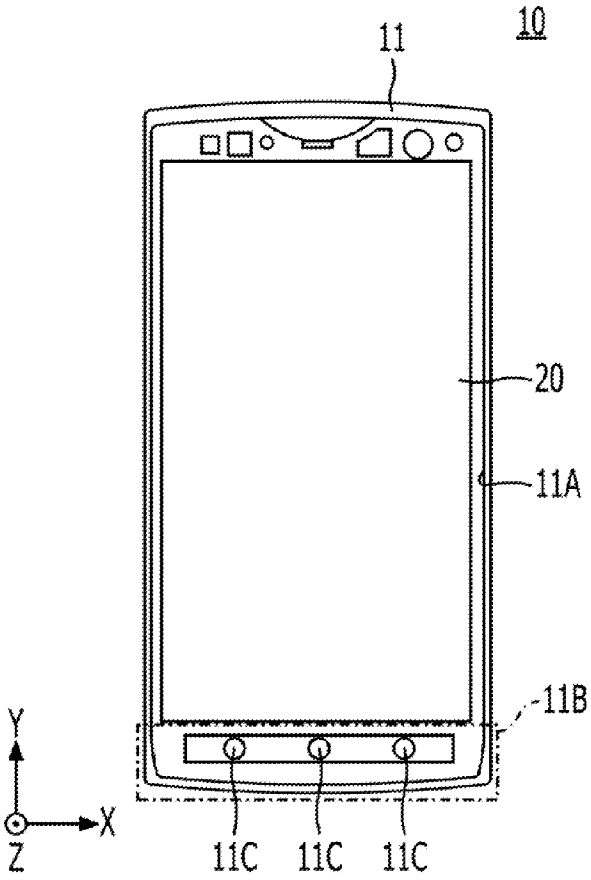
FIGS. 1A and 1B illustrate a portable terminal device according to a comparative example.
Figure 1A:
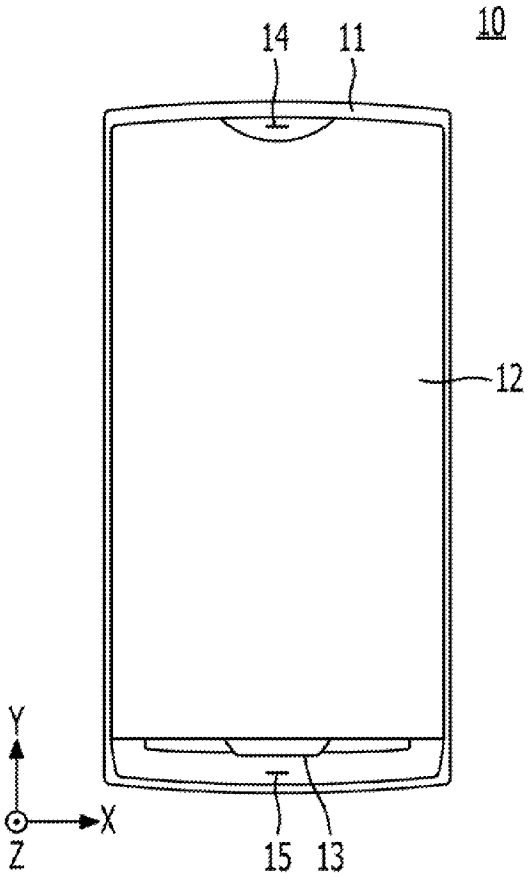

FIGS. 1A and 1B illustrate a portable terminal device 10 according to the comparative example. The portable terminal device 10 illustrated in FIGS. 1A and 1B is a terminal device for a smartphone. FIG. 1A is a plan view illustrating the portable terminal device 10, and FIG. 1B is a plan view illustrating the portable terminal device 10 from which a touch panel, operation buttons, a microphone, and a speaker are removed. An XYZ coordinate system is employed in FIGS. 1A and 1B as illustrated.

As illustrated in FIG. 1A, the portable terminal device 10 according to the comparative example includes a front case 11, a touch panel 12, operation buttons 13, a speaker 14, and a microphone 15.

The front case 11 is a front face side housing of the portable terminal device 10. The front case 11 accommodates the touch panel 12, and a metal frame for a liquid crystal display (LCD), a printed circuit board, and the like while being joined to a rear case on the back face side not illustrated. The front case 11 is made by molding. For example, polycarbonate may be used as a material for the front case 11. Glass fiber may be mixed into the polycarbonate.

The touch panel 12 is a combination of an LCD and a coordinate detection device, and is one of operation parts of the portable terminal device 10. Various operations may be performed on the portable terminal device 10 via the touch panel 12.

The operation buttons 13 are operation parts of the portable terminal device 10 provided in addition to the touch panel 12 and are allocated with certain functions of the portable terminal device 10. For example, the three operation buttons 13 illustrated in FIG. 1A function as a home key, a back key, and a menu key, respectively.

FIG. 1B illustrates the portable terminal device 10 from which the touch panel 12 and the operation buttons 13 depicted in FIG. 1A are removed. Since the touch panel 12 is mounted on a metal LCD frame 20, the metal LCD frame 20 is exposed through an opening 11A of the front case 11 in FIG. 1B. Three holes 11C into which projections on the back side of the operation buttons 13 are inserted are formed under the opening 11A of the front case 11.

An antenna of the portable terminal device 10 is mounted in a region enclosed by a broken line indicated by reference 11B. In order to obtain preferable emission characteristics for the antenna, it is desirable that there is no conductor in the vicinity of the antenna. Therefore, the metal LCD frame 20 is not present in the region enclosed by the broken line indicated by reference 11B and is accommodated inside the front case 11 and further on the Y-axis positive direction side than the region enclosed by the broken line indicated by reference 11B.

Similarly, the printed circuit board arranged on the back face side, that is, the Z-axis negative direction side of the metal LCD frame 20 is a multilayer board that includes a wiring layer, a power supply layer, and a ground layer. Thus, the printed circuit board is not present in the region enclosed by the broken line indicated by reference 11B and is accommodated inside the front case 11 and further on the Y-axis positive direction side than the region enclosed by the broken line indicated by reference 11B.

Figure 2B:
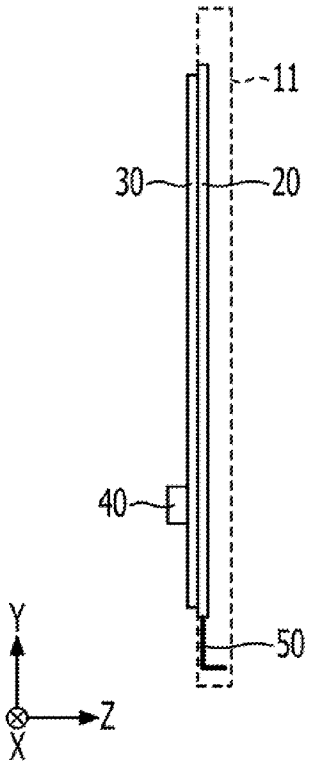
FIGS. 2A and 2B illustrate an inner structure of the portable terminal device according to the comparative example.
Figure 2A:
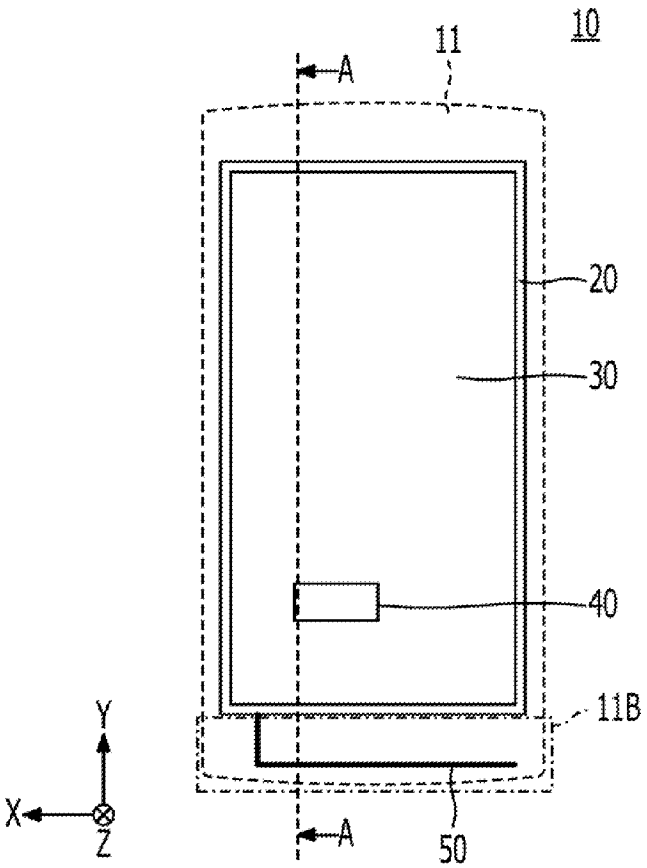

FIGS. 2A and 2B illustrate an inner structure of the portable terminal device 10 according to the comparative example. FIG. 2A is a rear view and FIG. 2B is a view illustrating a cross section along line A-A displayed in FIG. 2A. Similar to FIGS. 1A and 1B, an XYZ coordinate system is employed in FIGS. 2A and 2B as illustrated.

FIG. 2A illustrates the metal LCD frame 20, a printed circuit board 30, a wireless communication circuit 40, and an antenna 50.

The metal LCD frame 20 is a board that holds the touch panel 12 illustrated in FIG. 1A. Since the touch panel 12 is susceptible to deformation, the metal LCD frame 20, which is made of stainless steel (SUS), suppresses the deformation of the touch panel 12.

As described above, the printed circuit board 30 is a multilayer board that includes a wiring layer, a power supply layer, and a ground layer, and is arranged on the back face side, that is, the Z-axis negative direction side of the metal LCD frame 20. The metal LCD frame 20 is held at a ground potential by being connected to the ground layer of the printed circuit board 30.

The wireless communication circuit 40 is mounted on the back face of the printed circuit board 30, which is the face on the Z-axis negative direction side, and is connected to the antenna 50. The wireless communication circuit 40 transmits and receives signals via the antenna 50.

As described above, in the portable terminal device 10 according to the comparative example, the antenna 50 is arranged in the region enclosed by the broken line indicated by reference 11B whereas the metal LCD frame 20 and the printed circuit board 30 are not arranged in the region enclosed by the broken line indicated by reference 11B.

This is because when conductive layers of the metal LCD frame 20 and the printed circuit board 30, which include the wiring layer, the power supply layer, and the ground layer, are present in the vicinity of the antenna 50, the electric power of a signal output from the antenna 50 is offset and a preferable emission pattern is not obtained, thus decreasing the communication performance of the portable terminal device 10.

The antenna 50 of the typical portable terminal device 10 is arranged in the region enclosed by the broken line indicated by reference 11B and along an edge portion of the front case 11 illustrated in FIGS. 1A and 1B or the rear case. For example, the antenna 50 to be used may be formed by being stamped out of sheet metal or performing patterning on copper foil attached to a base material of a flexible board.

However, forming the antenna 50 by being stamped out of sheet metal or performing patterning on copper foil attached to a base material of a flexible board may involve high manufacturing costs.

Further, in the portable terminal device 10 according to the comparative example, the metal LCD frame 20 is not present in the region enclosed by the broken line indicated by reference 11B. Therefore, when for example, a user of the portable terminal device 10 drops the portable terminal device 10, the strength of a lower portion of the portable terminal device 10, where the region enclosed by the broken line indicated by reference 11B is positioned, may be insufficient.

Thus, according to the embodiments described below, a portable terminal device that reduces such possibilities may be provided.

Figure 3B:
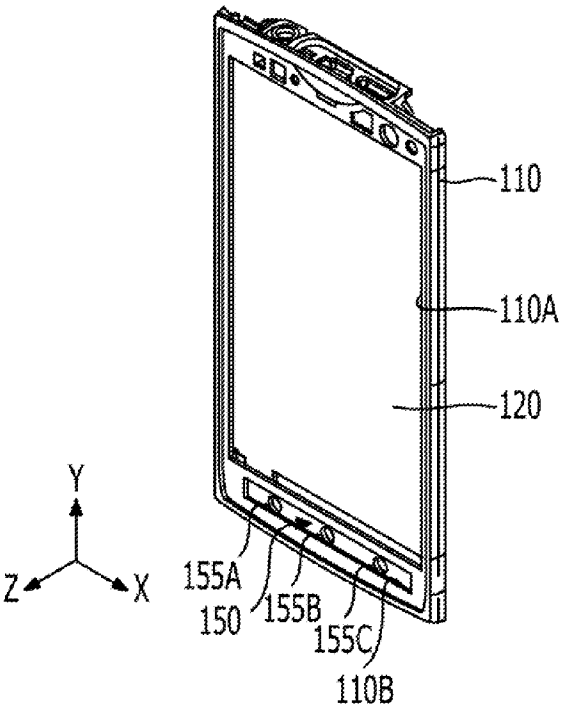
FIGS. 3A and 3B illustrate a portable terminal device according to an embodiment.
Figure 3A:
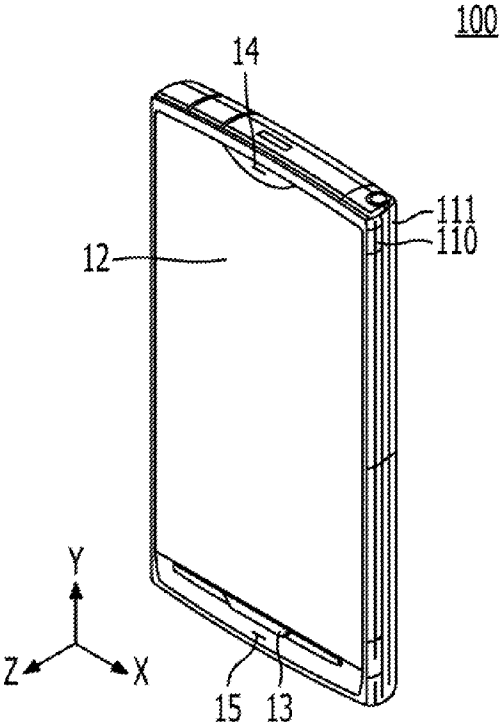

FIGS. 3A and 3B illustrate a portable terminal device 100 according to a first embodiment. FIG. 3A is a perspective view illustrating the front face side and FIG. 3B is a plan view illustrating the portable terminal device 100 from which a touch panel 12, operation buttons 13, and a rear case 111 are removed. In the present embodiment, the portable terminal device 100 is described as a terminal device for a smartphone.

Hereinafter, the same references are given to elements similar to the elements of the portable terminal device 10 according to the comparative example and the explanation for such elements is omitted. Similar to FIGS. 1A, 1B, 2A, and 2B, an XYZ coordinate system is employed in FIGS. 3A and 3B as illustrated.

As illustrated in FIG. 3A, the portable terminal device 100 includes a front case 110, the rear case 111, the touch panel 12, the operation buttons 13, a speaker 14, and a microphone 15.

As illustrated in FIG. 3A, the front case 110 is similar in appearance to the front case 11 of the portable terminal device 10 according to the comparative example. Further, the rear case 111 constitutes a housing of the portable terminal device 100 by being combined with the front case 110. For example, polycarbonate may be used as a material for the front case 110. Glass fiber may be mixed into the polycarbonate. As a material for the rear case 111, polyamide may be used. Glass fiber may be mixed into the polyamide.

When the rear case 111, the touch panel 12, the operation buttons 13, the speaker 14, and the microphone 15 are removed from the portable terminal device 100 as illustrated in FIG. 3B, a metal LCD frame 120 is exposed on the front face side through an opening 110A of the front case 110.

The metal LCD frame 120 of the portable terminal device 100 according to the first embodiment includes an antenna element 150, which is formed continuously and integrally with the metal LCD frame 120, in a lower portion of the metal LCD frame 120, that is, an end portion on the Y-axis negative direction side.

For example, the antenna element 150 is integrally formed with the metal LCD frame 120 by being stamped out of a metal plate together with the metal LCD frame 120 by using a die. In FIG. 3B, the antenna element 150 is partially exposed through an opening 110B of the front case 110. The opening 110B is an opening for positioning the operation buttons 13 and is arranged under the opening 110A for positioning the touch panel 12, that is, on the Y-axis negative direction side.

As long as the antenna element 150 is integrally formed with the metal LCD frame 120 from an identical metal plate, the antenna element 150 may be formed by using a method other than stamping. For example, the antenna element 150 may be formed by casting using a mold or by cutting a metal plate with a cutter or the like.

Figure 4B:
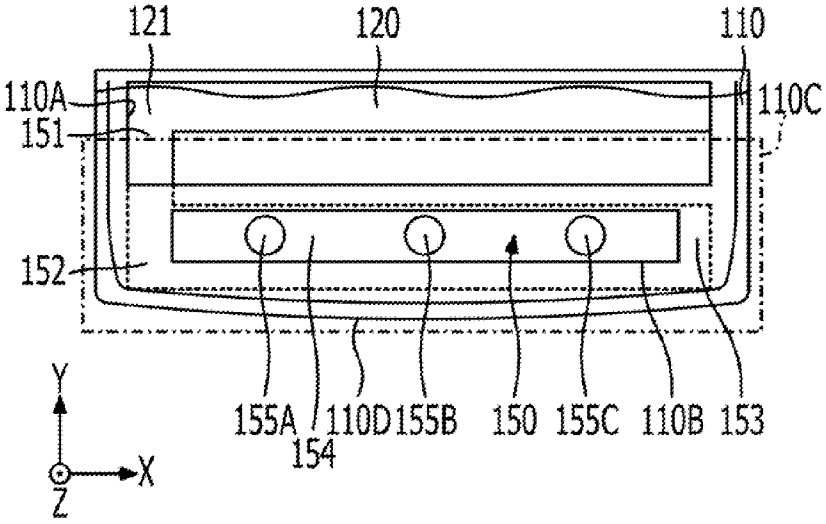
FIGS. 4A and 4B illustrate a front case, a metal frame of a liquid crystal display (LCD), and an antenna element of the portable terminal device according to the embodiment.
Figure 4A:
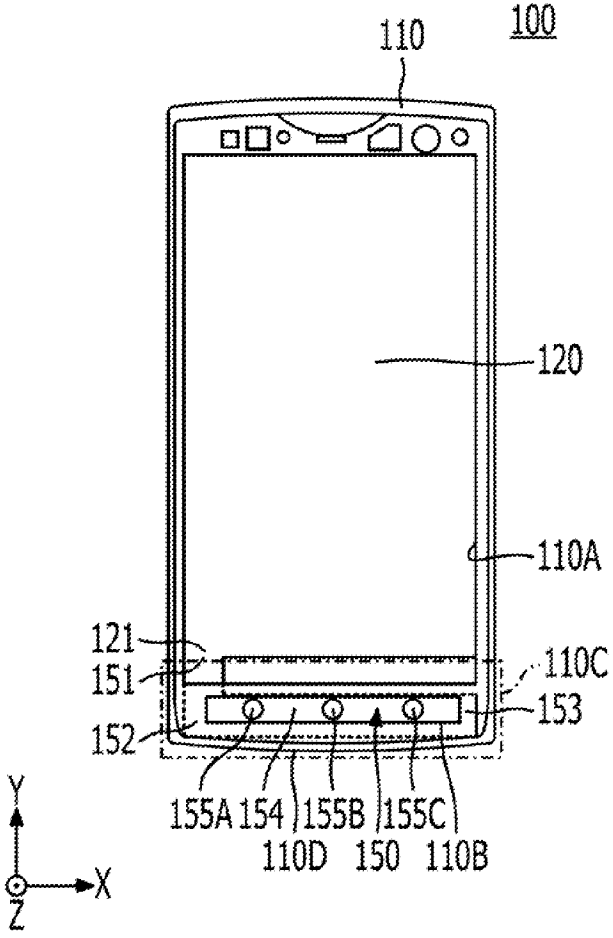

FIGS. 4A and 4B illustrate the front case 110, the metal LCD frame 120, and the antenna element 150 of the portable terminal device 100 according to the first embodiment. FIG. 4A is a plan view illustrating the front case 110, the metal LCD frame 120, and the antenna element 150 that are depicted in FIG. 3B, and FIG. 4B is an enlarged view of a region indicated by reference 110C, which is positioned in a lower portion of the front case 110 and the metal LCD frame 120 depicted in FIG. 4A.

The metal LCD frame 120 and the antenna element 150 according to the first embodiment are integrally formed with the front case 110 by insert forming.

As illustrated in FIGS. 4A and 4B using a dotted line, an end 151 of the antenna element 150 is connected to a corner portion 121 positioned on the X-axis negative direction side and the Y-axis negative direction side of the metal LCD frame 120, which is rectangular in a plan view. The antenna element 150 is drawn toward the Y-axis negative direction side and bent into an L shape in a corner portion 152 toward the X-axis positive direction side, and extends to another end 153.

The corner portion 152 is positioned in the vicinity of a corner on the X-axis negative direction side and the Y-axis negative direction side of the front case 110, and the other end 153 is positioned in the vicinity of a corner on the X-axis positive direction side and the Y-axis negative direction side. That is, the antenna element 150 is formed into an L shape by extending from the corner portion 121, which is positioned on the X-axis negative direction side and the Y-axis negative direction side of the metal LCD frame 120, along an edge 110D on the Y-axis negative direction side of the front case 110.

Further, the antenna element 150 includes a feed point 154 between the end 151 and the other end 153. The feed point 154 is at a position closer to the corner portion 152, which is between the corner portion 152 and the other end 153. How power feeding is performed is described below with reference to FIGS. 5A to 5C.

The antenna element 150 is provided with three holes 155A, 155B, and 155C. The holes 155A to 155C correspond to the three operation buttons 13 illustrated in FIG. 3A, respectively, and are formed so as to allow projections on the back side of the operation buttons 13 to be arranged through the holes 155A to 155C. The feed point 154 is positioned between the hole 155A and the hole 155B.

In FIGS. 4A and 4B, the feed point 154 and the three holes 155A to 155C are exposed through the opening 110B of the front case 110. That is, other than the portion exposed through the opening 110B, most of the antenna element 150 is fixed while being inserted into the front case 110. The relation between the position of the antenna element 150 and the position of the front case 110 is described in detail below with reference to FIGS. 7A and 7B.

Since the antenna element 150 described above is fed with power at the feed point 154 provided between the end 151 and the other end 153, the antenna element 150 functions as a so-called inverted-F antenna.

Figure 5A:
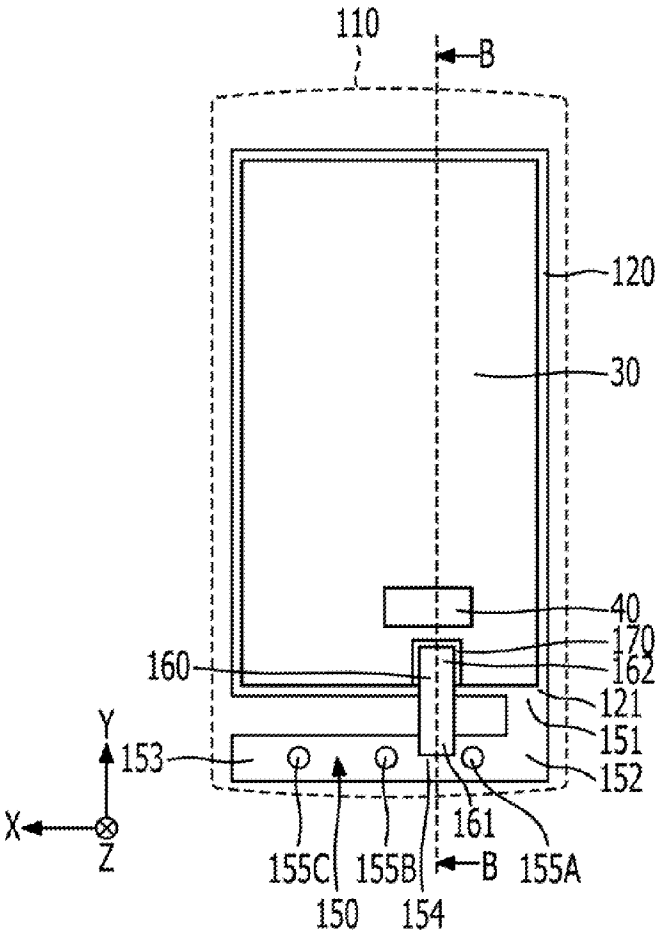
FIGS. 5A to 5C illustrate the metal LCD frame and a printed circuit board of the portable terminal device according to the embodiment.
Figure 5B:
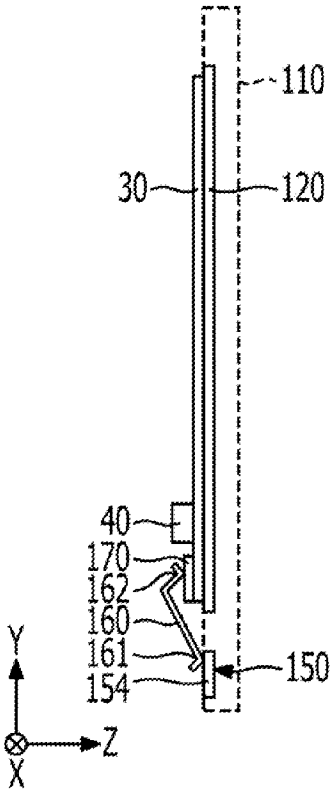
Figure 5C:
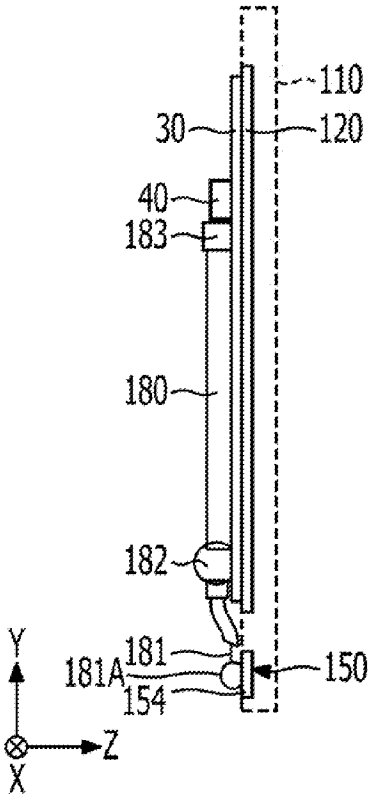

FIGS. 5A to 5C illustrate the metal LCD frame 120 and the printed circuit board 30 of the portable terminal device 100 according to the first embodiment. FIG. 5A is a rear view and FIG. 5B is a view illustrating a cross section along line A-A in FIG. 5A. Further, FIG. 5C illustrates a variation of the structure depicted in FIG. 5B. Similar to FIGS. 4A and 4B, an XYZ coordinate system is employed in FIGS. 5A to 5C as illustrated.

As illustrated in FIG. 5A, the printed circuit board 30 is arranged on the back face side of the metal LCD frame 120. Similar to the printed circuit board 30 illustrated in FIG. 2A, the wireless communication circuit 40 is mounted on the back face of the printed circuit board 30. Although FIG. 5B illustrates a structure in which the printed circuit board 30 is arranged directly on the back face side of the metal LCD frame 120, a structural object, such as a metal plate, may be provided between the metal LCD frame 120 and the printed circuit board 30.

Since FIG. 5A illustrates the back face on the side opposite the front face of the metal LCD frame 120, which is depicted in FIGS. 4A and 4B, the shape of the antenna element 150 is inverted when compared to FIGS. 4A and 4B.

When the antenna element 150 is integrally formed with the metal LCD frame 120 by stamping a metal plate with a die the stamping may be performed using a die that has a shape obtained by adding the L shape of the antenna element 150 to the rectangle of the metal LCD frame 120, as illustrated in FIG. 5A.

As illustrated in FIG. 5A, the end 151 of the antenna element 150 is connected to the corner portion 121 positioned on the X-axis negative direction side and the Y-axis negative direction side of the metal LCD frame 120, and the antenna element 150 is drawn toward the Y-axis negative direction side and bent into an L shape in the corner portion 152 toward the X-axis positive direction side, and extends to the other end 153. Further, as described above, the antenna element 150 is provided with the three holes 155A, 155B, and 155C. The three holes 155A, 155B, and 155C may be formed together with the antenna element 150 at the same time by stamping for example.

As described above, the antenna element 150 is formed into an L shape (in FIG. 5A, an inverted-L shape) that extends from the corner portion 121, which is positioned on the X-axis negative direction side and the Y-axis negative direction side of the metal LCD frame 120, along the edge 110D on the Y-axis negative direction side of the front case 110.

Further, as described above, the antenna element 150 includes the feed point 154 between the end 151 and the other end 153. The feed point 154 is at a position closer to the corner portion 152, which is between the corner portion 152 and the other end 153.

The antenna element 150 is connected to a contact land 170 through a contact spring 160 at the feed point 154.

The contact spring 160 is a plate spring formed by, for example, bending a copper sheet, and includes an end 161 and another end 162. The end 161 is in contact with the feed point 154 of the antenna element 150, and the other end 162 is in contact with the contact land 170. The contact spring 160 is fixed by, for example, being attached to the rear case 111 with a double-sided tape.

The contact spring 160 abuts the feed point 154 of the antenna element 150 and the contact land 170 by being pressed in the Z-axis direction when accommodated between the front case 110 and the rear case 111.

The contact land 170 is a land provided on the back face of the printed circuit board 30 and is formed by, for example, performing patterning on copper foil. The contact land 170 is connected to the wireless communication circuit 40 by wiring not illustrated. The wiring that connects the contact land 170 and the wireless communication circuit 40 may be wiring formed on the back face of the printed circuit board 30 or wiring formed on an inner layer. The wireless communication circuit 40 is connected to the ground layer of the printed circuit board 30.

Power feeding from the wireless communication circuit 40 may be performed for the feed point 154 by connecting the contact land 170 and the antenna element 150 through the contact spring 160.

Since the contact spring 160 abuts the feed point 154 of the antenna element 150 and the contact land 170 by being pressed in the Z-axis direction when accommodated between the front case 110 and the rear case 111 as described above, the contact spring 160 may be bent so as to have a height greater than a space between the back face of the printed circuit board 30 and the rear case 111 in the Z-axis direction when considering the natural length of the contact spring 160.

Thus, the antenna element 150 integrally formed with the metal LCD frame 120 of the portable terminal device 100 according to the first embodiment is fed with power from the wireless communication circuit 40 at the feed point 154 via the contact spring 160 and the contact land 170.

The feed point 154 is positioned between the end 151 and the other end 153 of the antenna element 150, and the end 151 is grounded by being connected to the corner portion 121 of the metal LCD frame 120 and the other end 153 is an open end.

Accordingly, the antenna element 150 integrally formed with the metal LCD frame 120 of the portable terminal device 100 according to the first embodiment functions as an inverted-F antenna.

Since the antenna element 150 is a monopole antenna, the length between the end 151 and the other end 153 may be set to be ¼ of a wavelength λ of a frequency to be used, that is, λ/4. Further, the feed point 154 may be at any position only when the position is between the end 151 and the other end 153, and for example, the feed point 154 may be set at a position suitable to adjust the bandwidth of the antenna element 150. The bandwidth referred to here is, for example, bandwidth that has characteristics obtained at a voltage standing wave ratio (VSWR) when the frequency to be used is a center frequency. In addition, the feed point 154 may be positioned at the other end 153.

Although FIGS. 5A and 5B illustrate the embodiment in which power is fed to the feed point 154 of the antenna element 150 using the contact spring 160 and the contact land 170, the antenna element 150 may be fed with power by using, for example, a coaxial cable.

For example, as illustrated in FIG. 5C, a core wire 181 on the side of one end of a coaxial cable 180 is connected to the feed point 154 of the antenna element 150 by solder 181A, and a shield wire on the side of the end of the coaxial cable 180 is connected to the ground layer of the printed circuit board 30 by solder 182 instead of using the contact spring 160 and the contact land 170 depicted in FIGS. 5A and 5B. Further, another end 183 of the coaxial cable 180 is connected to the wireless communication circuit 40. Also in this manner, power may be fed from the wireless communication circuit 40 to the feed point 154 of the antenna element 150.

Figure 6:
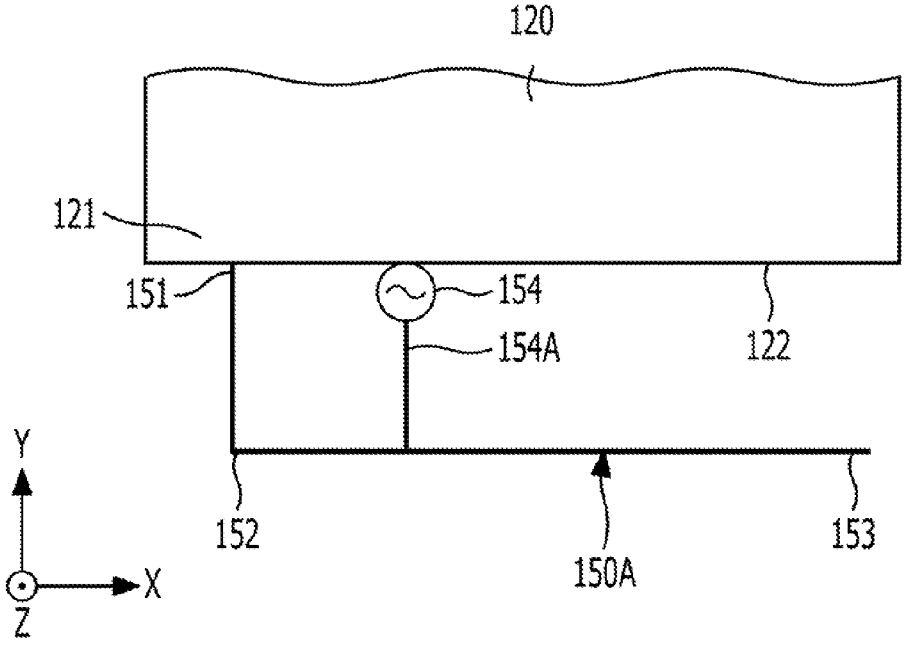
FIG. 6 illustrates a structure of an inverted-F antenna element.

FIG. 6 illustrates a structure of an inverted-F antenna element.

The antenna element 150 illustrated in FIGS. 5A, 5B, and 5C is equivalent to an inverted-F the antenna element 150A illustrated in FIG. 6. The end 151 of the inverted-F antenna element 150A illustrated in FIG. 6 is connected to the corner portion 121 of the metal LCD frame 120 functioning as a ground plane, and the inverted-F antenna element 150A is drawn toward the Y-axis negative direction side and bent into an L shape in the corner portion 152 toward the X-axis positive direction side, and extends to the other end 153.

FIG. 6 also illustrates a feed part 154 connected via a feed line 154A. The inverted-F antenna element 150A illustrated in FIG. 6 is equivalent to the antenna element 150 illustrated in FIGS. 5A, 5B, and 5C.

As described above, according to the first embodiment, the antenna element 150 integrally formed with the metal LCD frame 120 may be caused to function as an inverted-F antenna.

Next, a method of fixing the metal LCD frame 120 and the antenna element 150 is described with reference to FIGS. 7A and 7B.

Figure 7B:
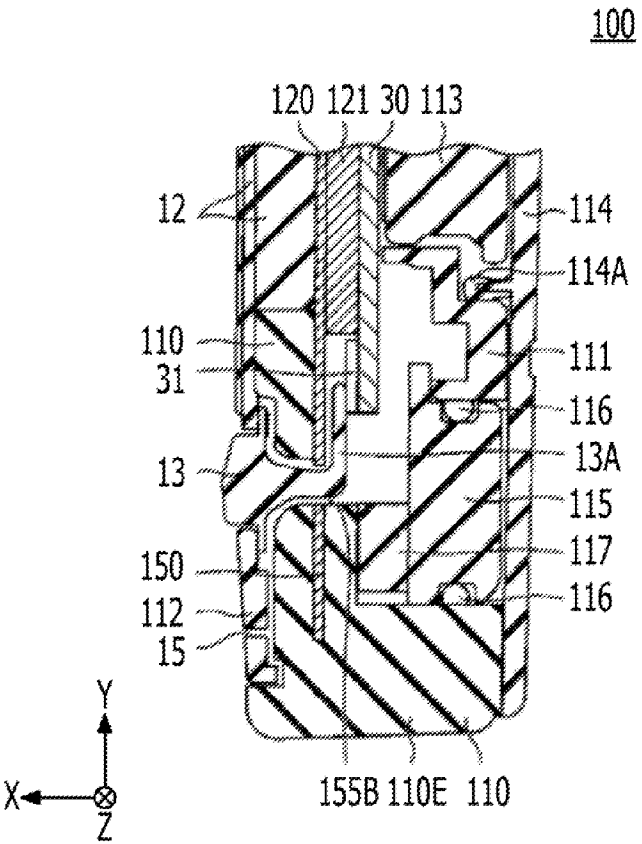
FIGS. 7A and 7B illustrate an inner structure of the portable terminal device according to the embodiment.
Figure 7A:
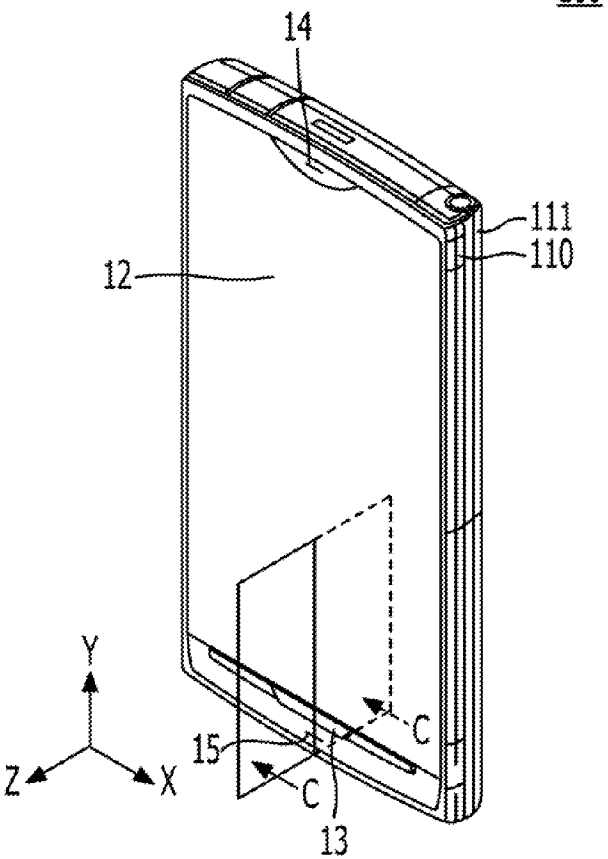

FIGS. 7A and 7B illustrate an inner structure of the portable terminal device 100 according to the first embodiment. FIG. 7A is a perspective view illustrating the portable terminal device 100, and FIG. 7B is a view illustrating a cross section along line C-C in FIG. 7A, which is drawn across a central portion of the hole 155B of the antenna element 150.

The portable terminal device 100 illustrated in FIG. 7A is similar to the portable terminal device 100 illustrated in FIG. 3A. In the sectional view in FIG. 7B, sectional structures of the front case 110, the metal LCD frame 120, and the antenna element 150 are largely illustrated and sectional structures of other parts are schematically illustrated.

As illustrated in FIG. 7B, which depicts the cross section along line C-C in FIG. 7A, the operation button 13 is arranged under the touch panel 12 and a decorative sheet 112 is attached under the operation button 13.

The touch panel 12 is held by the metal LCD frame 120. The metal LCD frame 120 is integrated with the front case 110 by insert forming. A metal plate 121 is arranged between the metal LCD frame 120 and the printed circuit board 30. The metal LCD frame 120 is electrically connected to the ground layer of the printed circuit board 30 via the metal plate 121. The printed circuit board 30 is arranged between the metal plate 121 and the rear case 111.

The insert forming referred to here means to mold the front case 110 by inserting the metal LCD frame 120 and the antenna element 150 in a die for molding the front case 110 and after performing alignment filling resin into the die. The metal LCD frame 120 and the antenna element 150 are integrally formed with the front case 110 by the insert forming. Also, the insert forming is synonymous with so-called insert molding.

A battery 113 is arranged over the rear case 111. In actuality, the rear case 111 extends on the Y-axis positive direction side and the battery 113 is accommodated in a depressed portion of the rear case 111 in a back view. The battery 113 is covered by a battery cover 114. The battery cover 114 engages with the rear case 111 by means of an engagement portion 114A. For example, the battery 113 is arranged in a lower portion of the entire portable terminal device 100 in the Y-axis direction.

A charging terminal 115 is arranged between a low portion 110E of the front case 110 and the rear case 111. The charging terminal 115 is sealed with waterproof rubber 116. A spacer 117 is arranged between the charging terminal 115 and the front case 110.

As described above, in the portable terminal device 100 according to the first embodiment, the metal LCD frame 120 and the antenna element 150 are integrated with the front case 110 by insert forming. The metal LCD frame 120 is integrally formed by insert forming with a middle portion, which is located in the Y-axis direction of the front case 110, and the antenna element 150 is fixed while being inserted in the low portion 110E of the front case 110 by insert forming.

Further, a projection 13A on the back side of the operation button 13 is arranged through the hole 155B of the antenna element 150 and bent toward the Y-axis positive direction side further on the Z-axis negative direction side than the antenna element 150. A top end of the projection 13A on the back side of the operation button 13 abuts a switch part 31 mounted on the printed circuit board 30. For example, the switch part 31 is a contact point when two flexible boards on which copper foil is included are arranged to face each other.

When the operation button 13 is pushed, the projection 13A on the back side pushes the switch part 31 such that the contact point of the switch part 31 is conductive.

Although FIG. 7B illustrates a cross section of the middle operation button 13 of the three operation buttons 13 depicted in FIG. 7A, the projections 13A on the back side of the other two operation buttons 13 are arranged through the holes 155A and 155C of the antenna element 150 and abut the switch parts 31.

As described above, since in the portable terminal device 100 according to the first embodiment, the metal LCD frame 120 and the antenna element 150 are integrally formed of an identical metal plate, the number of components and manufacturing costs may be reduced in comparison with the portable terminal device 10 according to the comparative example.

Further, in the portable terminal device 100 according to the first embodiment, the antenna element 150 is inserted into the low portion 110E of the front case 110 and fixed by being integrally formed with the front case 110 by insert forming.

Accordingly, the lower portion of the portable terminal device 100 may be reinforced with the metal LCD frame 120 and the antenna element 150 and the strength of the lower portion of the portable terminal device 100 may be enhanced.

Because with the portable terminal device 10 according to the comparative example, the metal LCD frame 20 is not present in the lower portion of the portable terminal device 10, the strength of the lower portion of the portable terminal device 10 may be insufficient when for example, a user of the portable terminal device 10 drops the portable terminal device 10.

However, in the portable terminal device 100 according to the first embodiment, the antenna element 150 formed of a metal plate identical with the metal plate for the metal LCD frame 120 is arranged in the lower portion of the portable terminal device 100, and the antenna element 150 is integrally formed with the low portion 110E of the front case 110 by insert forming.

Accordingly, the strength of the lower portion of the portable terminal device 100 according to the first embodiment is enhanced in comparison with the portable terminal device 10 according to the comparative example. The portable terminal device 100 according to the first embodiment has sufficient strength in the lower portion.

Thus, even when a user drops the portable terminal device 100, damage to the portable terminal device 100 may be suppressed.

In particular, when the portable terminal device 100 falls with the battery 113 being arranged in the lower portion of the entire portable terminal device 100 in the Y-axis direction, the lower portion of the portable terminal device 100 is likely to fall first. This is because the battery 113 is relatively heavy in comparison with other components included in the portable terminal device 100, and the center of gravity is in the lower portion.

When the weight distribution in the portable terminal device 100 is as described above, it is advantageous to reinforce the lower portion of the portable terminal device 100.

In the above-described embodiment, the antenna element 150 is fixed by being inserted into the low portion 110E of the front case 110 by insert forming.

However, when the rear case 111 extends to the lower portion of the portable terminal device 100, the antenna element 150 may be integrally formed with the rear case 111 by insert forming.

In addition, although in the above-described embodiment, most of the antenna element 150 is inserted in the front case 110, the antenna element 150 may be fixed by being at least partially inserted in the front case 110.

Further, although in the above-described embodiment, the antenna element 150 is arranged in the lower portion of the portable terminal device 100, another antenna element may be arranged in an upper portion of the portable terminal device 100 in addition to the lower portion of the portable terminal device 100. Similar to the antenna element 150 arranged in the lower portion of the portable terminal device 100, the antenna element thus provided to the upper portion may be integrally formed with the metal LCD frame 120 and may be integrally formed with the front case 110 by insert forming. The antenna element 150 may be provided to the upper portion instead of being provided to the lower portion of the portable terminal device 100.

Also, although in the above-described embodiment, the portable terminal device 100 is a terminal device for a smartphone, the portable terminal device 100 is not limited to a terminal device for a smartphone but may be a terminal device for a so-called mobile telephone or an information terminal device through which no telephone calls are performed.

Figure 8:
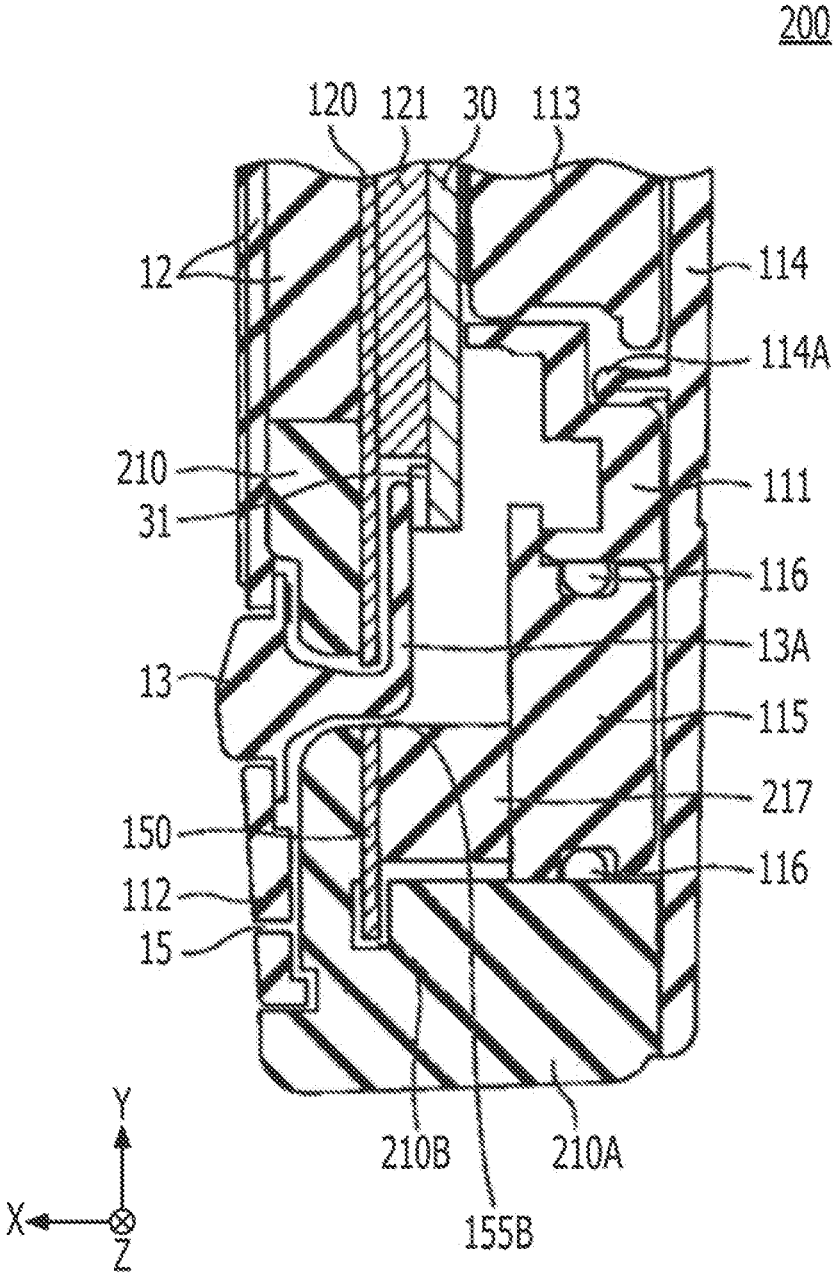
FIG. 8 illustrates a sectional structure of a lower portion of a portable terminal device according to another embodiment.

FIG. 8 illustrates a sectional structure of a lower portion of a portable terminal device 200 according to a second embodiment. The cross section illustrated in FIG. 8 corresponds to the cross section illustrated in FIG. 7B. Thus, the same references are given to elements similar to the elements of the portable terminal device 100 according to the first embodiment and explanation for such elements is omitted.

The portable terminal device 200 according to the second embodiment is similar in appearance to the portable terminal device 100 according to the first embodiment illustrated in FIG. 7A.

A front case 210 of the portable terminal device 200 according to the second embodiment is different in structure from the front case 110 of the portable terminal device 100 according to the first embodiment. Other than the front case, the portable terminal device 200 according to the second embodiment is similar in structure to the portable terminal device 100 according to the first embodiment.

As illustrated in FIG. 8, in the portable terminal device 200 according to the second embodiment, a groove 210B is formed in a low portion 210A of the front case 210. An antenna element 150 is inserted into the groove 210B.

That is, in the portable terminal device 200 according to the second embodiment, the antenna element 150 and a metal LCD frame 120 are not fixed to the front case 210 by insert forming but the antenna element 150 is fit into the groove 210B of the front case 210. According to the second embodiment, the metal LCD frame 120 and the front case 210 are fixed by inserting the antenna element 150 into the groove 210B of the front case 210. Further, a spacer 217 is provided between the antenna element 150 and the charging terminal 115.

In order to facilitate understanding, FIG. 8 illustrates the width of the groove 210B as being greater than the thickness of the antenna element 150. However, in actuality, the width of the groove 210B is approximately the same as the thickness of the antenna element 150 and the antenna element 150 is fit in the groove 210B.

As described above, since in the portable terminal device 200 according to the second embodiment, the metal LCD frame 120 and the antenna element 150 are integrally formed of an identical metal plate, the number of components and manufacturing costs may be reduced in comparison with the portable terminal device 10 according to the comparative example.

Further, in the portable terminal device 200 according to the second embodiment, the antenna element 150 is fit in the groove 210B of the front case 210 as described above.

Thus, the lower portion of the portable terminal device 200 may be reinforced with the metal LCD frame 120 and the antenna element 150, and the strength of the lower portion of the portable terminal device 200 may be enhanced.

The portable terminal device according to the present application is exemplified in the first embodiment and the second embodiment as described above. However, the present application is not limited to the embodiments disclosed herein in detail and may undergo various changes or modifications without departing from the scope of the aspects of the present application.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A portable terminal comprising:

a metal frame on which an LCD is mounted, the metal frame being grounded;

an antenna element having a first end, a second end, and a feed point between the first end of the antenna element and the second end of the antenna element, the antenna element being formed from the same piece of sheet metal used for the metal frame, the first end of the antenna element being connected to the metal frame; and a housing that accommodates the LCD, the metal frame, and the antenna element, wherein the antenna element includes a hole through which a projection of an operation button extends.

2. The portable terminal according to claim 1, wherein the metal frame is rectangular in a plan view, and the first end of the antenna element is connected to the metal frame in an end portion in a longitudinal direction of the metal frame.

3. The portable terminal according to claim 2, wherein the antenna element is fixed to the housing by being at least partially formed integrally with the housing by insert forming.

4. The portable terminal according to claim 3, wherein the antenna element is fixed to the housing by being at least partially fit into the groove in the housing.

5. The portable terminal according to claim 1, wherein the antenna element is an inverted-F antenna element.

6. The portable terminal according to claim 1, wherein the housing includes a groove having a width corresponding to a thickness of the antenna element.

7. A wireless communication method comprising:

feeding power via a feed point to an antenna element having a first end, a second end, and the feed point disposed between the first end of the antenna element and the second end of the antenna element, the antenna element being formed from a piece of sheet metal used for a metal frame on which an LCD is mounted, the metal frame being grounded, the first end of the antenna element being connected to the metal frame, and the LCD, the metal frame, and the antenna element being accommodated in a housing; and performing, using the antenna element, at least one of transmission and reception of a signal, wherein the antenna element includes a hole through which a projection of an operation button extends.

8. The wireless communication method according to claim 7, wherein the metal frame is rectangular in a plan view, and the first end of the antenna element is connected to the metal frame in an end portion in a longitudinal direction of the metal frame.

9. The wireless communication method according to claim 8, wherein the antenna element is fixed to the housing by being at least partially formed integrally with the housing by insert forming.

10. The wireless communication method according to claim 9, wherein the antenna element is fixed to the housing by being at least partially fit into the groove in the housing.

11. The wireless communication method according to claim 8, wherein the antenna element is an inverted-F antenna element.

12. The wireless communication method according to claim 7, wherein the housing includes a groove having a width corresponding to a thickness of the antenna element.

* * * * *